US005744905A

United States Patent [19]

Mehrotra et al.

[11] Patent Number: 5,744,905

[45] Date of Patent: Apr. 28, 1998

[54] EMISSION MATERIALS FOR DISCHARGE LAMPS AND METHOD FOR MANUFACTURING ELECTRODE STRUCTURES WITH SUCH MATERIALS

[75] Inventors: Vivek Mehrotra, Rye Brook, N.Y.; Hemant S. Betrabet, Veldhoven, Netherlands; David Robert Woodward, Morgantown; Thomas O. Leyh, Bridgeport, both of W. Va.; Susan McGee, Peekskill, N.Y.

[73] Assignee: Philips Electronics North America Corporation, New York, N.Y.

[21] Appl. No.: 916,747

[22] Filed: Aug. 19, 1997

Related U.S. Application Data

[63] Continuation of Ser. No. 759,509, Dec. 4, 1996, abandoned, which is a continuation of Ser. No. 363,182, Dec. 23, 1994.

[51] Int. Cl.[6] ..... H01J 1/62; H01J 63/04; H01J 17/20; H01J 61/12

[52] U.S. Cl. ..... 313/491; 313/575; 313/633; 313/346 R

[58] Field of Search ..... 313/346 R, 491–92, 313/493, 566, 574, 575, 630.31, 633, 483; 445/46, 50–52

[56] References Cited

U.S. PATENT DOCUMENTS

| | | | |
|---|---|---|---|
| 2,686,274 | 8/1954 | Rooksby | 313/212 |
| 2,911,376 | 11/1959 | Rudolph | 252/521 |
| 2,957,231 | 10/1960 | Davis et al. | 29/182.5 |
| 3,766,423 | 10/1973 | Menelly | 313/311 |
| 3,953,376 | 4/1976 | Kern | 252/521 |
| 3,969,279 | 7/1976 | Kern | 313/491 X |
| 4,031,426 | 6/1977 | Kern | 313/491 X |
| 4,210,840 | 7/1980 | Bhalla | 313/346 R X |
| 4,797,593 | 1/1989 | Saito et al. | 313/346 |
| 4,808,883 | 2/1989 | Iwaya et al. | 313/632 |
| 5,111,108 | 5/1992 | Goodman et al. | 313/630 |
| 5,258,687 | 11/1993 | Duggan | 313/631 |

FOREIGN PATENT DOCUMENTS

| | | | |
|---|---|---|---|
| 3749 | 12/1951 | Germany . | |
| 55-3104 | 1/1980 | Japan | H01J 9/02 |
| 57-44954 | 3/1982 | Japan | H01J 61/067 |
| 739367 | 10/1955 | United Kingdom . | |
| 782287 | 9/1957 | United Kingdom . | |

OTHER PUBLICATIONS

New Riverside University Dictionary Copyright 1984 by Houghton Mifflin Company.

"Uber die Beeinflussung des Sinterverhaltens von Wolfram", by Von J. Vacek, Planseeberichte fur Pulvermetallurgie, pp. 6–17.

*Primary Examiner*—Sandra L. O'Shea
*Assistant Examiner*—Mack Haynes
*Attorney, Agent, or Firm*—Arthur G. Schaier

[57] ABSTRACT

The present invention is directed to new electrode structures for use in fluorescent lamps in which a tungsten base structure is provided with electron emissive materials including one or more of barium titanate, barium zirconate, barium strontium zirconate, barium cerium oxide, barium tantalate, and barium strontium yittrium oxide. Amounts of MgO may be added to improve or change emitter properties. A composite electrode structure can be formed by way of coating a tungsten coil with a slurry of this material, or providing powdered mixtures of both the electron emissive material and tungsten material and sintering this powdered material into a high density composite electrode structure.

4 Claims, 1 Drawing Sheet

Figure 1A:
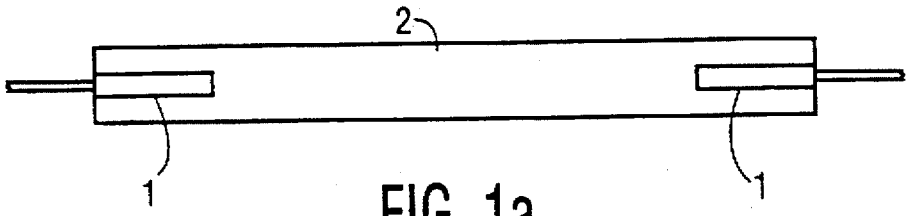

EMISSION MATERIALS FOR DISCHARGE LAMPS AND METHOD FOR MANUFACTURING ELECTRODE STRUCTURES WITH SUCH MATERIALS

This is a continuation of application Ser. No. 08/759,509, filed Dec. 4, 1996, now abandoned, which is a continuation of application Ser. No. 08/363,182, filed Dec. 23, 1994.

The present invention relates to improved electrodes for discharge lamps, and more particularly, to new emission materials for coated and composite electrodes for fluorescent type lamps.

CROSS REFERENCE TO RELATED APPLICATIONS

The present application is related to the following three (3) pending application Ser. No. 08/363,185 now abandoned, and Ser. No. 08/832,895, and 08/611,311 now abandoned, and Ser. No. 08/363,177, which is now abandoned.

BACKGROUND OF THE INVENTION

The life of fluorescent lamps is mainly dependent upon the electrodes. Commercially available lamps mainly use an electrode coil of tungsten which is coated with a material for emitting electrons. For good ignition and long life (including lumen maintenance) of such lamps, the emitter must have a low work function, low evaporation rate, and high resistance to sputtering.

The emitter material is applied to the electrode coil in the form of a mixture of carbonates of barium (Ba), strontium (Sr) and calcium (Ca) in a coating process, such as dip coating in which a binder is used. The carbonates of these emitter materials are used because barium oxide (BaO), which is a highly effective electron emitter, is highly hygroscopic and cannot be handled in air. After forming these electrodes and sealing the lamp, the electrode coil is heated according to a specified schedule to convert the carbonates into oxides and to remove the binder from the coating.

This process, known as "treating" can be problematic and is somewhat of a black art. Incomplete binder burn out or conversion to oxides leads to impurities in the lamp which increase the ignition voltage and generally lead to instabilities during lamp operation. Because the treating process is carried out during lamp assembly, it slows down the production line which is a major disadvantage.

Additionally, the quality of the electrode cannot be tested prior to sealing in the lamp.

Other emitter coatings are known in the art. For example, Japanese reference JP-A-553104 discloses an emitter coating of various titanates of barium and calcium on a tungsten filament. British Patent Specification GB 739,367 discloses a fused coating of barium oxide and magnesium oxide where the barium oxide is formed from barium carbonate for fusing. British Patent Specification GB 782,287 discloses a coating of electron emissive material on a tungsten electrode where the emissive material is barium oxide (BaO) particles which are coated with barium zirconate ($BaZrO_3$). In these prior arrangements, the process of "treating" must always be carried out to form a workable lamp electrode with effective electron emissive material. U.S. Pat. No. 4,210,840 discloses an electrode for high pressure discharge lamps having emitter materials of barium and strontium zirconate. In this patent, the electrode operates at much higher temperatures in high intensity discharge (HID) lamps. It is not evident that the same emitter materials will operate effectively in a low temperature, low pressure lamp.

Instead of coil electrodes of tungsten, for example, composite electrodes have also been used. These composite electrodes have the advantage that they can be completely processed outside of the lamp and the quality more closely controlled. In this respect, U.S. Pat. No. 2,686,274 forms an electrode having an electron emissive material of barium orthotitanate ($Ba_2TiO_4$). Other portions of alkaline earth oxides may be present, such as strontium titanate, or a compound obtained by heating barium carbonate, strontium carbonate and titanium dioxide. These compounds are then made into electrode rods via extrusion and subsequent sintering without any metal, such as tungsten, being added. Finally, U.S. Pat. No. 2,957,231 also forms electrode materials from a highly porous metal, such as tungsten acting as a sponge for an emissive material in a flash tube. The activated emissive material is composed of barium aluminate, aluminum oxide and barium. The structure, however, is highly porous and not effective for fabricating small electrodes attached to feedthrough leadwires because of their poor mechanical strength.

All of this prior art fails to produce treatment fee electron emissive coatings for discharge lamp electrodes.

SUMMARY OF THE INVENTION

It is the object of the present invention to provide new electron emission materials for electrode structures in discharge lamps, such as fluorescent lamps, which avoid and eliminate the prior problems. In particular, the prior process of "treating" is unnecessary and no longer a deterrent to the construction of discharge lamps, such as fluorescent lamps.

It has been found, for example, that an electrode structure for fluorescent lamps can be provided from a sintered composite structure which includes a sintered material of tungsten and at least one of barium titanate ($BaTiO_3$), 30 wt. % $BaTiO_3$+70 wt. % MgO, 50 wt. % $BaTiO_3$+50 wt. % MgO, $BaZrO_3$ $Ba_{0.5}Sr_{0.5}ZrO_3$, $Ba_4Ta_2O_9$, $(Ba,Sr)Y_2O_4$, $Ba_3SrTa_2O_9$, and $BaCeO_3$ powders. This electrode structure can form highly efficient electrodes for discharge lamps which avoid the process of "treating", while increasing the life of the electrodes and reducing any blackening of walls of fluorescent lamps, such as instant start types.

Such emission materials can be used as constituents in composite electrodes for narrow-diameter fluorescent lamps where the geometry prevents use of conventional coated coils.

The electrode structures provided according to the present invention can be formed either by coating tungsten electrode coils, such as stick electrodes, or forming a sintered mixture of tungsten powders and electron emissive powdered materials in a highly dense structure having a theoretical density of at least 85%, and preferably greater than 90%.

The coating of tungsten electrodes with barium titanate, 30 wt. % barium titanate+70 wt. % magnesium oxide, 50 wt. % barium titanate+50 wt. % magnesium oxide, barium zirconate, barium strontium zirconate, barium tantalate, barium yittrium oxide and barium cerium oxide can be carried out by forming a slurry of the pure powders of these compounds or mixtures thereof in an organic binder. The tungsten electrode structure is coated with this slurry and the coated tungsten electrode is then heated to eliminate the organic binder, resulting in a tungsten electrode coated with a highly effective electron emissive material, such as of barium and magnesium oxides. The elimination of the binder can be performed outside the lamp without affecting the electron emissive coating.

Consequently, electrode structures are formed with electron emission coatings that exhibit higher sputtering resistance and decreased evaporation rates at lamp electrode operating temperatures. This leads to decreased wall blackening in lamps, better lumen maintenance and longer life of the lamp structures.

The mixture of barium titanate with magnesium oxide provides a higher sputtering resistance and lower evaporation loss of the electron emitter. Such emitters may also be combined with other high sputtering resistant, hard and high melting point materials, such as silicon carbide.

Barium zirconate ($BaZrO_3$), and barium strontium zirconate have a high melting point and exhibit a low evaporation rate. These materials would be suitable as an emitter for high intensity discharge (HID) lamps where the electrode operates at a much higher temperature. As such, they can replace radioactive thoria ($ThO_2$), as the emitter on tungsten, which is presently used as the emitter in halide lamps.

The formation of the electrode structures according to the present invention may also be provided by a powder of at least one of numerous emitter oxide materials, such as $BaTiO_3$, $BaZrO_3$, $Ba_{0.5}Sr_{0.5}ZrO_3$, $Ba_4Ta_2O_9$, $BaCeO_3$ and (Ba, Sr) $Y_2O_4$, mixed with a tungsten powder and sintered to perform a high density composite electrode structure.

BRIEF DESCRIPTION OF THE DRAWING FIGURES

Figure 1B:
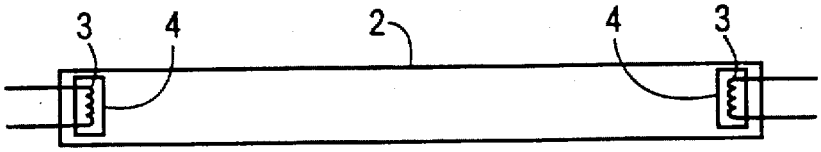

FIGS. 1*a* and 1*b* show, respectively, the structure of a fluorescent lamp having an electrode structure in accordance with the present invention.

DESCRIPTION OF THE INVENTION

An electrode structure 1 for a fluorescent lamp 2, such as shown in FIG. 1*a*, may encompass, according to the present invention, a sintered structure of tungsten and electron emissive material. Alternatively, as seen in FIG. 1*b*, a tungsten coil 4 is embedded or coated by the new emission materials of the present invention.

This new electron emissive material utilized for the present invention encompasses at least one of barium titanate, (barium zirconate, barium strontium zirconate, barium tantalate, barium cerium oxide, barium strontium tantalate, and barium yittrium oxide, for example. As an example, combinations of at least one of barium titanate, 30 % by wt. barium titanate+70 % by wt. magnesium oxide, 50 % by wt. barium titanate+50 % by wt. of magnesium oxide and/or barium zirconate may be used. All of these emission materials may be used without any in-lamp processing.

In the arrangement of a tungsten stick electrode coil, such as shown in FIG. 1*b* and used in fluorescent lamps, the electron emissive material may be a coating of a pure powder of a mixture of the electron emissive materials stated above. The mixed powder or mixtures are formed into a slurry by mixing with an organic binder, such as nitrocellulose, butanol and/or butyl acetate. This binder is similar to that previously used for coating electron emissive materials. The coated coils are then incorporated into a standard fluorescent lamp, such as a cool white F40T12 40 watt fluorescent lamp. The organic binder is burned out during lamp degassing by heating the coils in vacuum upon passing current through them. Such current is of 0.5 A maximum. The lamps are then ignited and operated using a standard reference ballast and operates at values such as 188.8 volts, 430 mA with a filament voltage at 3.6 volts and an operating voltage of 236 volts. Alternatively, to greatly increase the manufacturing speed the binder burn off is performed outside the lamp. Since these new emissive materials are non-hygroscopic, no in-lamp processing is necessary.

Results of such operation are summarized in Table I. For comparison, typical figures for lamps incorporating prior art triple carbonate-based emitter structures are also shown.

TABLE I

| COATING MATERIAL | LAMP VOLTAGE (V) | LAMP POWER (W) |
|---|---|---|
| $BaTiO_3$ | 103.6 (ave.) | 40.3 (ave.) |
| 30 wt. % $BaTiO_3$ + 70 wt. % MgO | 112.3 (ave.) | 43.8 (ave.) |
| 50 wt. % $BaTiO_3$ + 50 wt. % MgO | 120.9 | 44.95 |
| $BaZrO_3$ | 104.6 (ave.) | 39.13 (ave.) |
| Triple carbonate | 104 ± 3 | 41 ± 1 |

The electron emission materials of the present invention exhibit superior properties over conventional triple carbonate materials. Such carbonates of barium, strontium, and calcium have been used in the past because oxide forms of barium by itself which is the main emitter material cannot be handled in air because of its highly hygroscopic nature. Thus, such carbonates are converted into oxides during the lamp making process. Such treatment is problematic and is somewhat of a "black art". Incomplete binder burn out or conversion to oxide leads to impurities in the lamp which increases the ignition voltage and can lead to spiraling effects in the lamp and consequent instabilities.

The electron emission materials of the present invention can be used directly and can be handled in air. Since no chemical conversion is required and the compounds are thoroughly stable, the likelihood of incorporating impurities into the lamp is thereby reduced. Consequently, a simpler binder burn out can be used in coating techniques with the present invention.

In addition to simplifications of these processing steps, the new electron emission materials may exhibit higher sputtering resistance and decreased evaporation rates at the electrode operating temperatures. This leads to decreased wall-blackening of the lamps and better lumen maintenance, as well as longer life.

As an example of the present invention, barium titanate having a melting point of 1650° C. is mixed with magnesium oxide having a melting point of 2850° C. in order to provide higher sputtering resistance and lower the evaporation loss of the emitter. Such barium titanate emitter may also be combined with other high sputtering resistant, hard material and high melting point materials, such as SiC. On the other hand, $BaZrO_3$ has a melting point of 2500° C. and exhibits a low evaporation rate. Similarly, emitter materials of the present invention, such as $Ba_{0.5}Sr_{0.5}ZrO_3$, can be used as coatings on tungsten coils for electrodes in fluorescent lamps. These materials are also suitable as an emitter for high intensity discharge (HID) lamps where the electrode operates at a much higher temperature and replaces thoria ($ThO_2$) as the emitter in tungsten. Thoria is currently used as an emitter in metal halide lamps, but because of its radioactivity, replacements are desirable.

The powders of the electron emitter materials of the present invention may be combined with a tungsten powder so that sintered composite electrodes are obtained. This leads to complete elimination of the treating step currently used with triple-carbonate coated tungsten coils and the elimination of organic binder-based slurries. Such simplification in the lamp making process leads to an increase in production line speed and impurity free lamps since there are no impurities that can be produced in the treatment of the electrode structure.

Composite sintered electrodes also offer geometric flexibility since there is no restriction on the positioning of the electrode with respect to the discharge tube. Conventionally coated tungsten coils are usually positioned perpendicular to the axis of the discharge tube. Composite electrodes, however, can either be positioned perpendicularly or parallel to this axis. The flexibility in placing the composite electrodes parallel to the axis of the lamp, as shown in FIG. 1*a*, allows the formation of narrow diameter fluorescent tubes having diameters of 6 mm or less.

Further, the possibility of longer life by high loading of electron emitter materials is obtained. Also, more uniformity in lamp-life results due to a tighter controlled fabrication procedure.

Various new emission materials according to the present invention have been investigated and found to be useful. They include $Ba_3Y_4O_9$, $BaY_2O_4$, $BaCeO_3$, $Ba_{0.75}Sr_{0.25}Y_2O_4$, $Ba_{0.5}Sr_{0.5}Y_2O_4$, $Ba_3Sc_4O_9$, $Ba_2TiO_4$, $Ba_4Ta_2O_9$, $Ba_{0.5}Sr_{0.5}TiO_3$, $BaLa_2O_4$, $BaZrO_3$, $BaAl_2O_4$, $Ba_5Ta_4O_{15}$, $BaTiO_3$, $Ba_{0.33}Sr_{0.33}Ca_{0.33}TiO_3$, $BaSiO_3$, $Ba_{0.5}Sr_{0.5}ZrO_3$, and $BaTa_2O_6$. These emission materials have been formed to have varying degrees of weight loss and moisture sensitivity. The apparent work function of each increases in the order listed.

What we claim:

1. An electrode structure for fluorescent lamps comprising a sintered composite structure including a sintered material of tungsten and at least one of barium zirconate and barium strontium zirconate.

2. An electrode structure for fluorescent lamps comprising a sintered composite structure including a sintered material of tungsten and barium tantalate.

3. An electrode structure according to claim 1, wherein magnesium oxide is added in amounts of at least 50 wt %.

4. An electrode structure according to claim 1, wherein at least one of $BaTiO_3$, 30 wt % $BaTiO_3$+70 wt % MgO, 50 wt % $BaTiO_3$+50 wt % MgO, $BaZrO_3$, $Ba_{0.5}Sr_{0.5}ZrO_3$, $Ba_4Ta_2O_9$, $BaCeO_3$ and (Ba, Sr) $Y_2O_4$ is used.

* * * * *